US007594877B2

(12) United States Patent
Anderson et al.

(10) Patent No.: US 7,594,877 B2
(45) Date of Patent: Sep. 29, 2009

(54) CLIMBER APPLIANCE

(75) Inventors: Timothy T. Anderson, Antioch, IL (US); Juliette C. Daly, Arlington Heights, IL (US); Byron T. DeKnock, Des Plains, IL (US); Joe Immordino, Hoffman Estates, IL (US); Marcos Roimicher, Lombard, IL (US); Eric White, Elgin, IL (US)

(73) Assignee: Brunswick Corporation, Lake Forest, IL (US)

( * ) Notice: Subject to any disclaimer, the term of this patent is extended or adjusted under 35 U.S.C. 154(b) by 5 days.

(21) Appl. No.: 11/710,576

(22) Filed: Feb. 26, 2007

(65) Prior Publication Data

US 2007/0219063 A1 Sep. 20, 2007

Related U.S. Application Data

(60) Provisional application No. 60/781,838, filed on Mar. 13, 2006.

(51) Int. Cl.
*A63B 22/04* (2006.01)

(52) U.S. Cl. ..... 482/52; 482/51; 482/70

(58) Field of Classification Search ..... 482/51, 482/52, 53, 57, 70, 71, 79, 80, 110, 111; 434/247, 255, 258, 261; 472/88, 89, 90, 472/91; D21/668, 669, 670, 671
See application file for complete search history.

(56) References Cited

U.S. PATENT DOCUMENTS 3,497,215 A 2/1970 Harrison et al.
3,566,861 A 3/1971 Weiss ..... 128/25
3,592,466 A 7/1971 Parsons ..... 272/69
3,970,302 A * 7/1976 McFee ..... 482/53
D263,490 S * 3/1982 Hickman ..... D21/670
4,346,886 A * 8/1982 Cox et al. ..... 482/72
4,496,147 A * 1/1985 DeCloux et al. ..... 482/53
4,529,194 A * 7/1985 Haaheim ..... 482/70
4,645,201 A * 2/1987 Evans ..... 482/70
4,681,316 A 7/1987 DeCloux ..... 272/130
4,684,121 A * 8/1987 Nestegard ..... 482/70
4,685,666 A * 8/1987 DeCloux ..... 482/70
4,685,669 A * 8/1987 DeCloux ..... 482/113
4,687,195 A 8/1987 Potts ..... 272/69
4,708,338 A 11/1987 Potts ..... 272/70
4,709,918 A * 12/1987 Grinblat ..... 482/70
4,733,858 A * 3/1988 Lan ..... 482/53
4,743,015 A * 5/1988 Marshall ..... 482/70
4,776,582 A * 10/1988 Ramhorst ..... 482/54

(Continued)

OTHER PUBLICATIONS

Description of Versa Climber (4 pages), printed from www.versaclimber.com on Mar. 12, 2006.

*Primary Examiner*—Loan H Thanh
*Assistant Examiner*—Daniel F Roland
(74) *Attorney, Agent, or Firm*—Michael B. McMurry

(57) ABSTRACT

An exercise apparatus to simulate climbing is described that includes such features as arm handles that move in synchronism with the motion of foot pedals to provide a total body workout; side handrails; a mounting step; linear foot movement at a simulated climbing angle; a three point support structure using a vertical support column; pedal track covers; a mechanism to provide constant resistance to pedal motion; and pedal impact absorption.

7 Claims, 13 Drawing Sheets

U.S. PATENT DOCUMENTS

| | | | | | |
|---|---|---|---|---|---|
| 4,813,667 | A * | 3/1989 | Watterson | 482/70 |
| 4,900,012 | A * | 2/1990 | Fu | 482/52 |
| 4,938,474 | A | 7/1990 | Sweeney et al. | 272/70 |
| 4,960,276 | A * | 10/1990 | Feuer et al. | 482/70 |
| 5,000,442 | A * | 3/1991 | Dalebout et al. | 482/70 |
| 5,090,690 | A | 2/1992 | Huang | 272/70 |
| D326,695 | S * | 6/1992 | Evans | D21/670 |
| 5,135,447 | A | 8/1992 | Robards, Jr. et al. | 482/52 |
| 5,145,481 | A * | 9/1992 | Friedebach | 482/70 |
| 5,180,351 | A | 1/1993 | Ehrenfried | 482/52 |
| 5,181,894 | A * | 1/1993 | Shieng | 482/70 |
| 5,186,697 | A | 2/1993 | Rennex | 482/52 |
| 5,192,257 | A * | 3/1993 | Panasewicz | 482/70 |
| 5,195,935 | A | 3/1993 | Fencel | 482/70 |
| 5,222,928 | A * | 6/1993 | Yacullo | 482/71 |
| 5,238,462 | A | 8/1993 | Cinke et al. | 482/52 |
| 5,267,922 | A * | 12/1993 | Robinson | 482/53 |
| 5,277,678 | A * | 1/1994 | Friedebach et al. | 482/70 |
| 5,295,927 | A | 3/1994 | Easley et al. | 482/52 |
| 5,295,928 | A | 3/1994 | Rennex | 482/52 |
| 5,318,487 | A | 6/1994 | Golen et al. | 482/5 |
| 5,338,273 | A * | 8/1994 | Metcalf et al. | 482/70 |
| 5,403,252 | A | 4/1995 | Leon et al. | 482/5 |
| 5,407,409 | A * | 4/1995 | Tang | 482/70 |
| 5,417,630 | A * | 5/1995 | Schultz | 482/70 |
| 5,499,958 | A * | 3/1996 | Hess | 482/79 |
| 5,503,607 | A * | 4/1996 | Lo | 482/52 |
| 5,575,740 | A * | 11/1996 | Piaget et al. | 482/70 |
| 5,685,804 | A * | 11/1997 | Whan-Tong et al. | 482/51 |
| 5,782,722 | A * | 7/1998 | Sands et al. | 482/52 |
| 5,792,029 | A * | 8/1998 | Gordon | 482/52 |
| 5,820,524 | A * | 10/1998 | Chen | 482/51 |
| 5,846,166 | A * | 12/1998 | Kuo | 482/52 |
| 5,855,537 | A * | 1/1999 | Coody et al. | 482/54 |
| 5,897,458 | A * | 4/1999 | Farhat | 482/52 |
| 5,899,833 | A * | 5/1999 | Ryan et al. | 482/52 |
| 5,947,872 | A * | 9/1999 | Ryan et al. | 482/51 |
| 5,997,445 | A * | 12/1999 | Maresh et al. | 482/70 |
| 6,019,710 | A * | 2/2000 | Dalebout et al. | 482/70 |
| 6,099,439 | A * | 8/2000 | Ryan et al. | 482/51 |
| 6,146,313 | A * | 11/2000 | Whan-Tong et al. | 482/51 |
| 6,149,551 | A * | 11/2000 | Pyles et al. | 482/52 |
| 6,165,107 | A * | 12/2000 | Birrell | 482/70 |
| 6,183,398 | B1 * | 2/2001 | Rufino et al. | 482/57 |
| 6,238,321 | B1 | 5/2001 | Arnold et al. | 482/52 |
| 6,302,830 | B1 * | 10/2001 | Stearns | 482/70 |
| 6,390,954 | B1 * | 5/2002 | Lee | 482/52 |
| 6,454,682 | B1 * | 9/2002 | Kuo | 482/52 |
| 6,482,130 | B1 * | 11/2002 | Pasero et al. | 482/51 |
| 6,514,180 | B1 * | 2/2003 | Rawls | 482/70 |
| 6,659,915 | B2 * | 12/2003 | Klein | 482/51 |
| 6,698,779 | B2 * | 3/2004 | Jeng | 280/210 |
| 6,752,744 | B2 * | 6/2004 | Arnold et al. | 482/52 |
| 6,758,790 | B1 * | 7/2004 | Ellis | 482/52 |
| 6,786,850 | B2 * | 9/2004 | Nizamuddin | 482/51 |
| 6,855,093 | B2 * | 2/2005 | Anderson et al. | 482/52 |
| 6,875,160 | B2 * | 4/2005 | Watterson et al. | 482/57 |
| 6,905,441 | B2 | 6/2005 | Anderson et al. | 482/52 |
| 6,926,646 | B1 * | 8/2005 | Nguyen | 482/71 |
| 6,939,271 | B1 * | 9/2005 | Whan-Tong et al. | 482/52 |
| 6,991,588 | B1 * | 1/2006 | Adams | 482/71 |
| 7,022,049 | B2 * | 4/2006 | Ryan et al. | 482/51 |
| 7,037,242 | B2 * | 5/2006 | Lo et al. | 482/52 |
| 7,052,439 | B2 * | 5/2006 | Anderson et al. | 482/52 |
| 7,153,238 | B2 * | 12/2006 | Anderson et al. | 482/52 |
| 7,244,218 | B1 * | 7/2007 | Lin et al. | 482/52 |
| 7,270,626 | B2 * | 9/2007 | Porth | 482/52 |
| 7,276,017 | B2 * | 10/2007 | Chen | 482/52 |
| 7,303,509 | B2 * | 12/2007 | Schroder | 482/52 |
| D565,130 | S * | 3/2008 | Olson | D21/670 |
| 7,361,122 | B2 * | 4/2008 | Porth | 482/52 |
| 7,377,879 | B1 * | 5/2008 | Chen | 482/51 |
| 7,479,093 | B1 * | 1/2009 | Immordino et al. | 482/52 |
| 2001/0012811 | A1 * | 8/2001 | Gordon | 482/70 |
| 2001/0023219 | A1 * | 9/2001 | Arnold et al. | 482/57 |
| 2002/0042329 | A1 * | 4/2002 | Nizamuddin | 482/51 |
| 2002/0072454 | A1 * | 6/2002 | Klein | 482/52 |
| 2002/0082146 | A1 * | 6/2002 | Stearns | 482/54 |
| 2002/0128122 | A1 * | 9/2002 | Miller | 482/52 |
| 2003/0013582 | A1 * | 1/2003 | Anderson et al. | 482/52 |
| 2003/0013583 | A1 * | 1/2003 | Anderson et al. | 482/52 |
| 2003/0022763 | A1 * | 1/2003 | Ryan et al. | 482/51 |
| 2003/0060335 | A1 * | 3/2003 | Wang | 482/51 |
| 2003/0083177 | A1 * | 5/2003 | Tung | 482/51 |
| 2003/0166434 | A1 * | 9/2003 | Lopez-Santillana et al. | 482/52 |
| 2003/0216222 | A1 * | 11/2003 | Kuo | 482/52 |
| 2004/0043871 | A1 * | 3/2004 | Chang | 482/52 |
| 2005/0075218 | A1 * | 4/2005 | Anderson et al. | 482/52 |
| 2005/0148438 | A1 * | 7/2005 | Carlsen et al. | 482/52 |
| 2005/0164835 | A1 * | 7/2005 | Porth | 482/52 |
| 2005/0181911 | A1 * | 8/2005 | Porth | 482/52 |
| 2005/0227817 | A1 * | 10/2005 | Anderson et al. | 482/52 |
| 2005/0250621 | A1 * | 11/2005 | Corbalis et al. | 482/52 |
| 2005/0277516 | A1 * | 12/2005 | Girard et al. | 482/52 |
| 2006/0046902 | A1 * | 3/2006 | Chang | 482/52 |
| 2006/0116247 | A1 * | 6/2006 | Dyer et al. | 482/52 |
| 2006/0183605 | A1 * | 8/2006 | Dyer et al. | 482/52 |
| 2006/0189445 | A1 * | 8/2006 | Stewart et al. | 482/52 |
| 2006/0189447 | A1 * | 8/2006 | Dyer et al. | 482/52 |
| 2006/0281604 | A1 * | 12/2006 | Stewart et al. | 482/51 |
| 2006/0287168 | A1 * | 12/2006 | Nizam | 482/71 |
| 2007/0054779 | A1 * | 3/2007 | Lee | 482/52 |
| 2007/0060449 | A1 * | 3/2007 | Lo | 482/52 |
| 2007/0060450 | A1 * | 3/2007 | Lo | 482/52 |
| 2007/0072742 | A1 * | 3/2007 | Chen | 482/52 |
| 2007/0087907 | A1 * | 4/2007 | Rodgers, Jr. | 482/52 |
| 2007/0117684 | A1 * | 5/2007 | Liao et al. | 482/52 |
| 2007/0117685 | A1 * | 5/2007 | Liao et al. | 482/52 |
| 2007/0117686 | A1 * | 5/2007 | Liao et al. | 482/52 |
| 2007/0161464 | A1 * | 7/2007 | Chiles et al. | 482/52 |
| 2007/0197345 | A1 * | 8/2007 | Wallace et al. | 482/8 |
| 2007/0232457 | A1 * | 10/2007 | Porth | 482/51 |
| 2007/0238581 | A1 * | 10/2007 | Malazinsky | 482/52 |
| 2007/0238582 | A1 * | 10/2007 | Lee | 482/52 |
| 2008/0032867 | A1 * | 2/2008 | Liao et al. | 482/52 |
| 2008/0070755 | A1 * | 3/2008 | McKee et al. | 482/52 |
| 2008/0125291 | A1 * | 5/2008 | Watt et al. | 482/52 |
| 2008/0139366 | A1 * | 6/2008 | Born et al. | 482/52 |

* cited by examiner

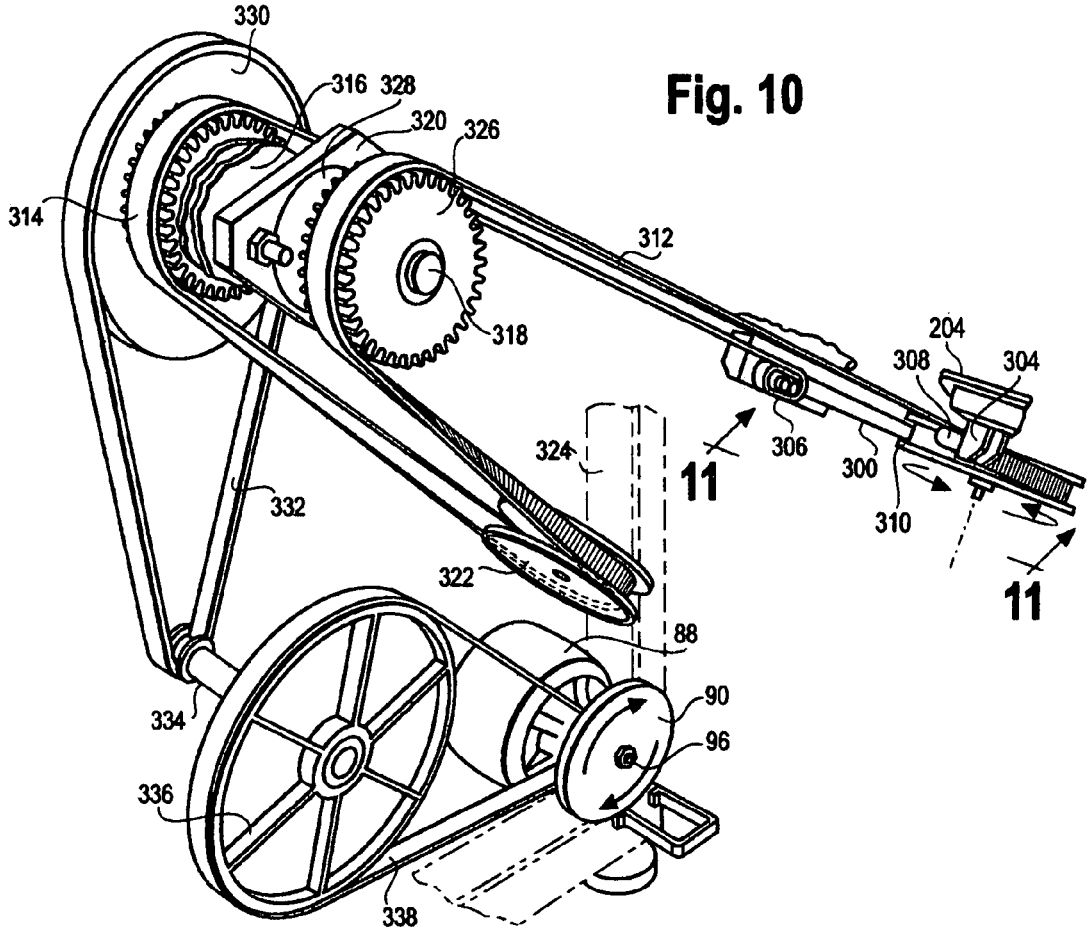
Fig. 10
Fig. 11
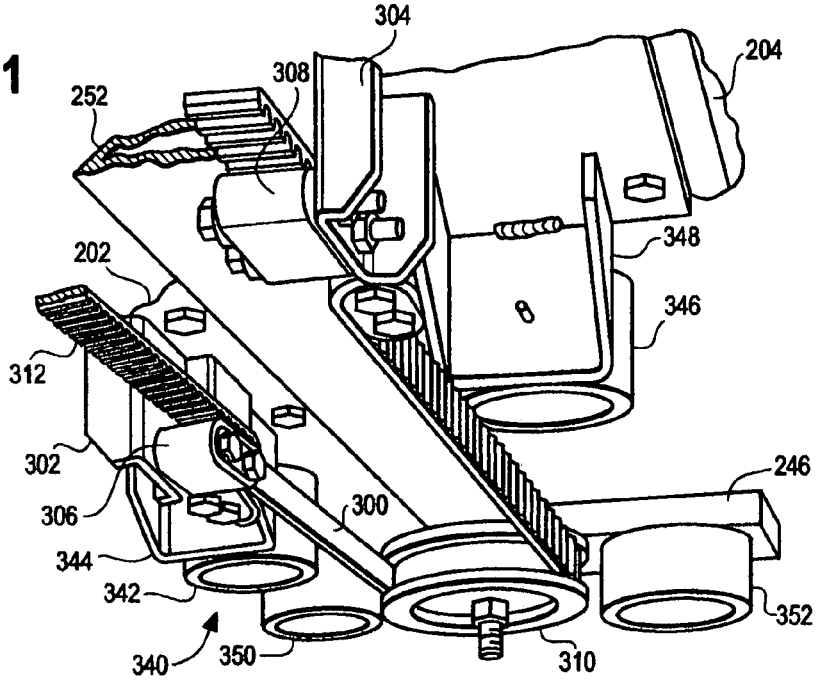

CLIMBER APPLIANCE

CROSS-REFERENCE TO RELATED APPLICATIONS

This application claims priority on provisional application Ser. No. 60/781,838, filed Mar. 13, 2006.

FIELD OF THE OF THE DESCRIBED APPARATUS

The described apparatus relates generally to exercise equipment and, more particularly, to exercise equipment that can be used to provide a user with a climbing type exercise.

BACKGROUND

Climbing is recognized as a particularly effective type of aerobic exercise, and as a result, exercise machines facilitating this type of exercise are popular for both home and health club use. There have been a variety of approaches taken in designing stair climbing apparatus as illustrated in U.S. Pat. Nos. 3,497,215, 4,687,195, 5,135,447, 5,180,351, 5,195,935, 5,222,928, 5,238,462, 5,318,487, 5,403,252, 6,855,093, 7,153,238 and Re. 34,959 as well as PCT application WO/94/02214. Typically these machines utilize a pair of pedals which are adapted for vertical reciprocating motion to provide a user who is standing on the pedals with a simulated climbing exercise. The vertical reciprocating motion is generally translated into a rotary motion by a suitable system of belts, gears and clutches, for example. The rotary motion that is imparted to a shaft, flywheel or the like is usually opposed by a variable source of resistance force, typically an alternator, eddy current break or the like that is responsive to a control signal for selectively varying the level of resistance. Also, it is not unusual to include features such as controlling and monitoring the speed of the pedals by the operator or by computer programs. Other approaches additionally provide for an upper body workout. For example, many health clubs have climbing walls. Another example is the Versa Climber apparatus sold by Heart Rate, Inc. of Costa Mesa, Calif. which is a mechanical hydraulic device that along with pedals provides a set of moveable handholds for an upper body workout.

SUMMARY OF THE DESCRIPTION

Therefore, given the increasing popularity of climbing as an exercise, one object of the described apparatus is to provide an improved climbing exercise apparatus as well as an apparatus that can provide for an improved climbing experience.

BRIEF DESCRIPTION OF THE DRAWINGS

FIG. 10 is an enlarged sectioned perspective view of the load and pedal connection assembly of FIG. 9;

FIG. 11 is an enlarged sectioned bottom perspective view taken along lines 11-11 of FIG. 10 illustrating a portion of the pedal connection assembly and a pedal impact absorption arrangement;

DETAILED DESCRIPTION

Figure 1:
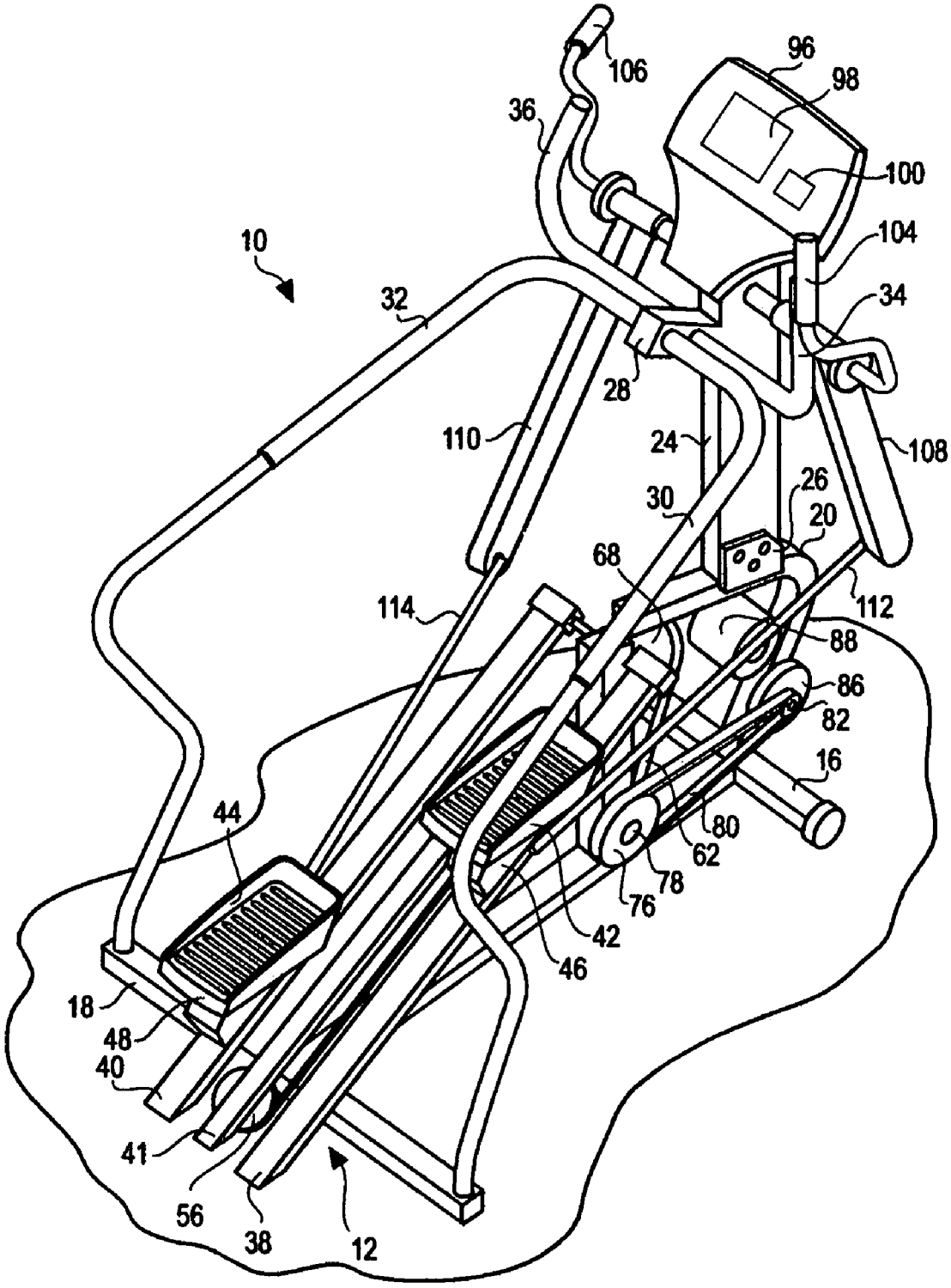
FIG. 1 is a right perspective side view of a climber mechanism illustrating a first embodiment of certain aspects of a climber mechanism.
Figure 2A:
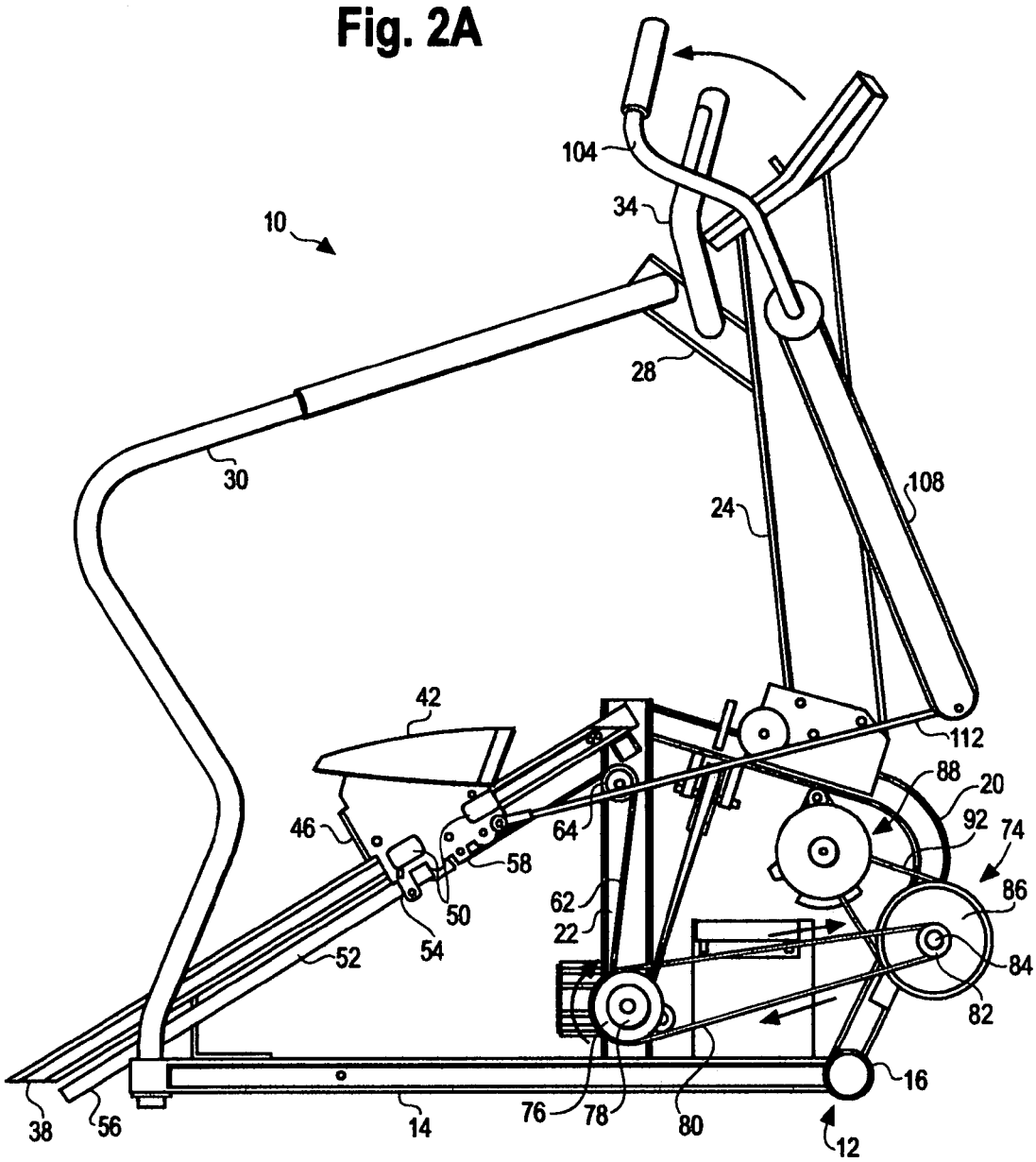
FIGS. 2A and 2B provide a right side view of the mechanism of FIG. 1 with pedals, a handrail and arm handles in a first and in a second position respectively.
Figure 2B:
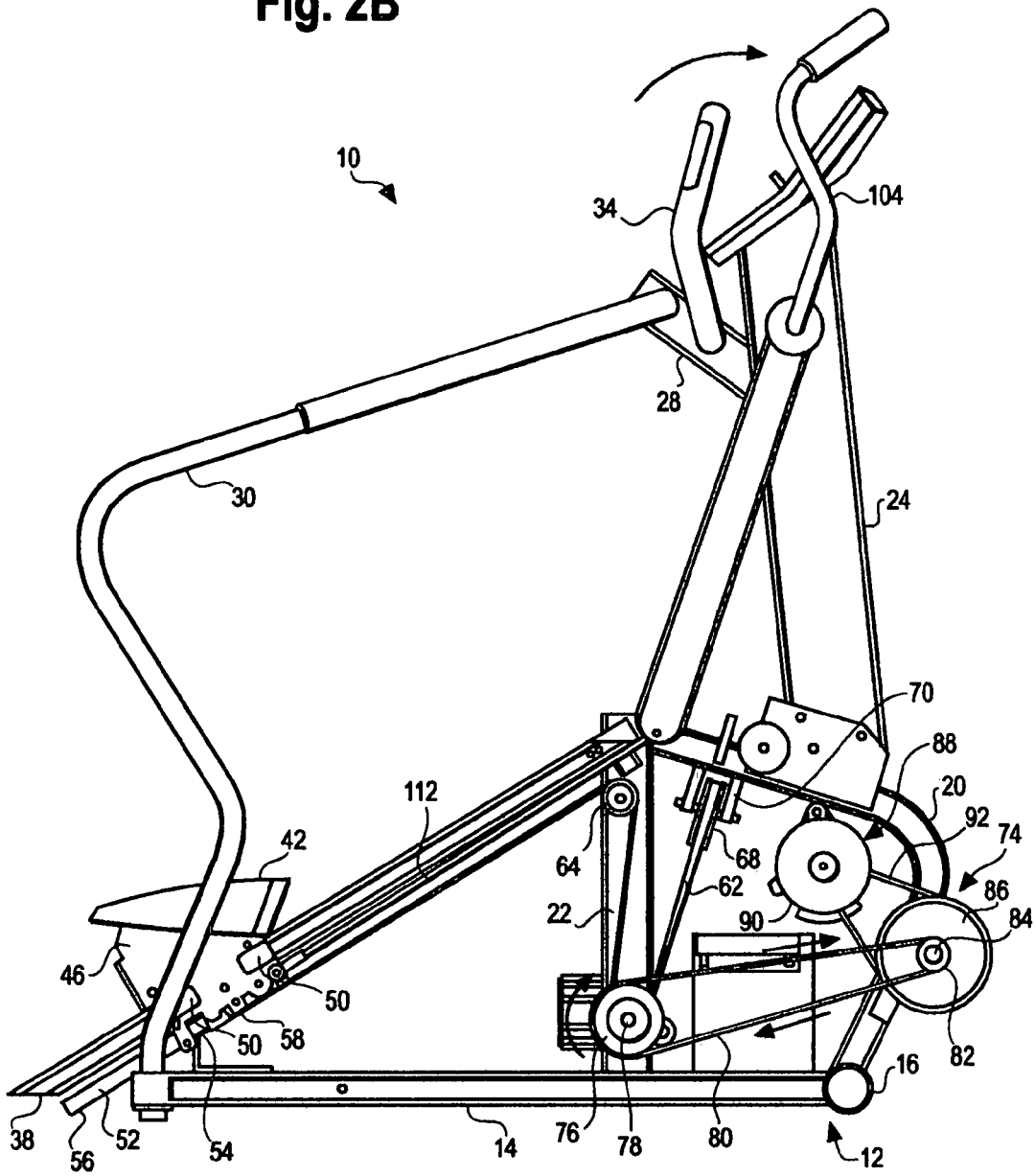

FIGS. 1, 2A-B and 3 provide views of an example of a first embodiment of a climber mechanism 10 that provides an illustrative environment for describing certain aspects a climber mechanism 10. For simplicity, only the right pedal, handrails and arm handles of the climber mechanism 10 are shown in FIGS. 2A-B. Support for the mechanism 10 on a horizontal support surface 11 such as a floor is provided by a frame 12 that includes: a horizontal frame member 14, a forward floor support 16, a rear floor support 18, a curved center support 20 secured to the horizontal support member 14 and forward floor support 16, a central vertical frame member 22 secured between the horizontal frame member 14 and the curved center support 20, and a vertical support member 24 secured to the curved center support 20 by a pair of brackets 26 and to the horizontal support member 14. In addition, extending from a handrail support 28 that is attached to the vertical support member 24 is a pair of side handrails 30 and 32 and a pair of generally upwardly extending fixed hand supports 34 and 36. In the embodiment shown in FIGS. 1-3 a pair of tracks 38 and 40 are connected to the vertical frame member 22 and the horizontal frame member 14 at an angle of preferably about 30 degrees to the floor. It has been found that an angle of 30 degrees provides the preferred angle to simulate the climbing of terrain such as hills, although variations of 10 to 15 degrees from the preferred 30 degrees can in some circumstances be desirable. A rear frame member 41 is located between the tracks 38 and 40 and likewise connected to the vertical frame member 22 and the horizontal frame member 14 such that the member 41 is parallel to the tracks 38 and 40.

Figure 6:
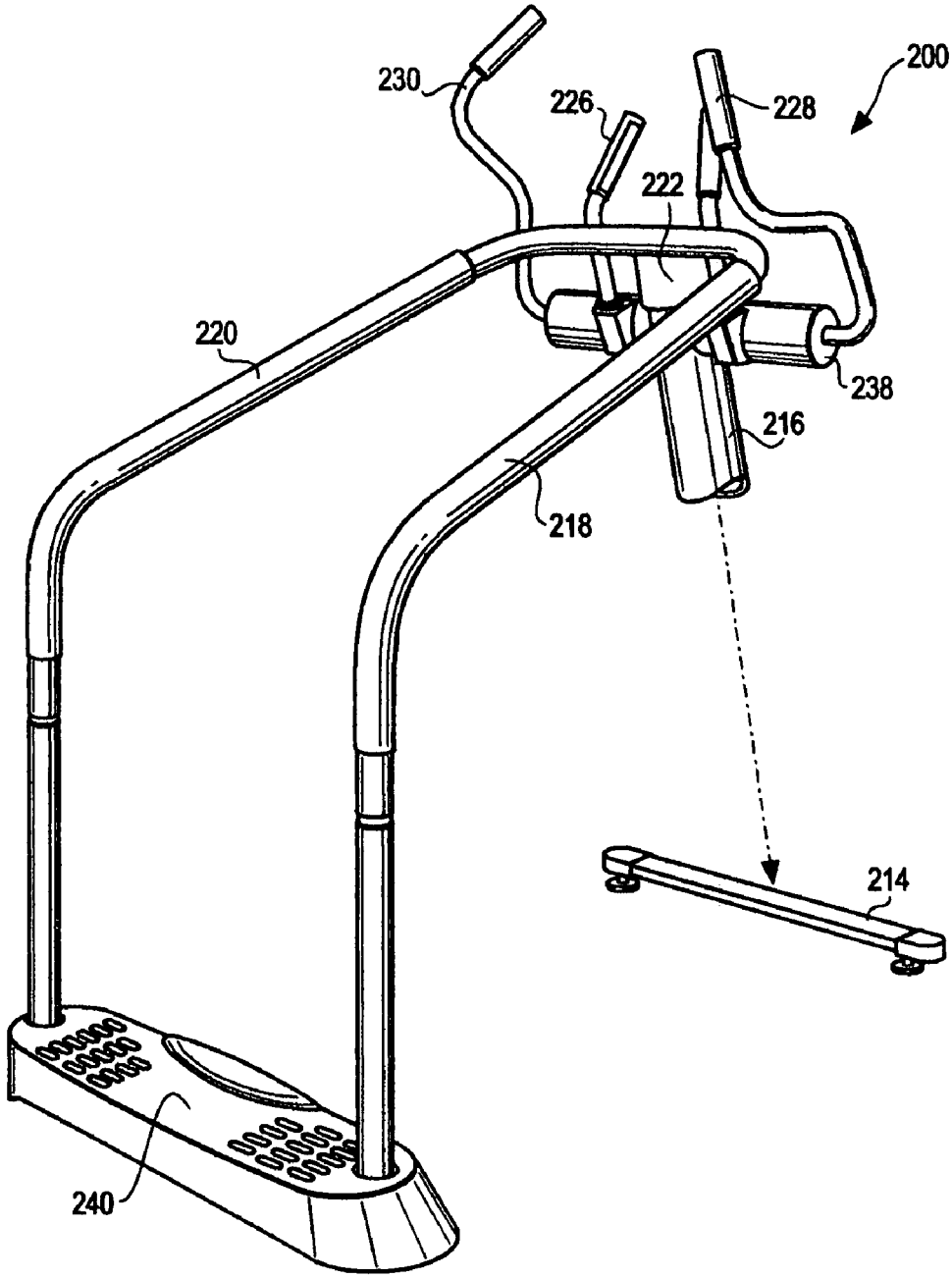
FIG. 6 is a right perspective side view of a portion of the climber mechanism of FIG. 5 illustrating certain aspects of the handle bar arrangement and support frame.
Figure 7:
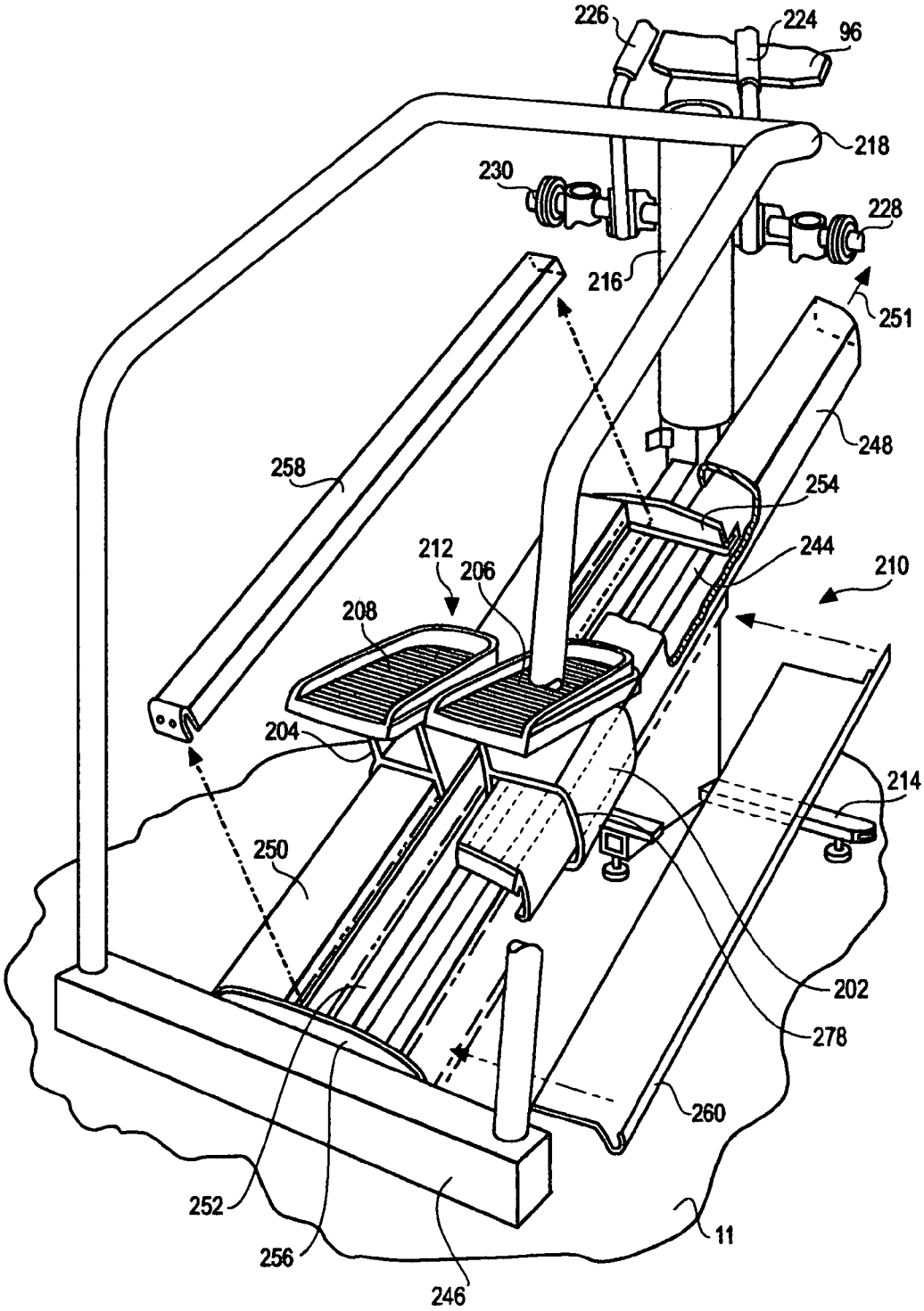
FIG. 7 is a sectioned right perspective side view of a portion of the climber mechanism of FIG. 5 illustrating certain aspects of the track and pedal assemblies.

The climbing mechanism includes a pair of pedals 42 and 44 that are mounted for movement along the tracks 38 and 40 respectively. Although the pedals 42 and 44 can be mounted on the tracks 38 and 40 by a number of different mechanisms, preferably a pair of pedal support mechanisms 46 and 48 of the type as shown in FIGS. 6 and 7 of U.S. Pat. No. 6,905,441 are used for this purpose and in this case would include a set of guide rollers 50. By the same token, the tracks 38 and 40 are substantially linear although there may be some implementations of the climbing mechanism 10 where nonlinear or curved tracks might be desirable. In this particular implementation of the climber 10, a belt 52 is attached to a lower rear portion of each of the pedal support mechanisms 46 and 48 at a point 54 and lead around a pulley 56 that in turn is rotatably attached to the rear frame member 41. Also attached at a point 58 of the right pedal mechanism 46 and to a point 60 of the second pedal mechanism 48 is a drive belt 62. Preferably, the belt 52 is a ribbed rubber belt but other flexible members can be used such a linked chain. In the embodiment of the climber mechanism shown in FIGS. 1-4, the drive belt 62 extends from the first pedal mechanism 46 to an idler pulley 64 mounted for rotation on frame member 22 then extends to downwardly over the pulley 64 to a first one way clutch 66. The drive belt 62 is engaged with a grooved pulley on the first one way clutch 66, twisted 90 degrees and extends up and over a central idler pulley 68. The central idler pulley 68 is mounted for rotation on the frame member 20 utilizing a pulley support structure 70 as shown in the figures. Twisted back 90 degrees, the control belt 62 is engaged with a second one-way clutch 72 mounted for rotation on frame member 22 then extends to the attachment point 60 on the second pedal mechanism 44.

In operation, the pedal connection mechanism including belt 52, although not necessary for the basic operation of the climber 10, will act to cause one of the pedals, for example pedal 42 to move downwardly along track 38 when the other pedal, for example pedal 44 moves upwardly along the track 40. By the same token, the pedal connection mechanism including the drive belt 62 will act to cause one of the pedals, for example pedal 42 to move upwardly along track 38 when the other pedal, for example pedal 44 moves downwardly along the track 40. These connection mechanisms result in what can be termed a dependent pedal operation where the motion of the pedals 42 and 44 are dependent on the motion of the other pedal. This represents the preferred operation of the climber 10, but it should be understood that under certain circumstances independent operation of pedals might be considered desirable for a climber mechanism.

Figure 3:
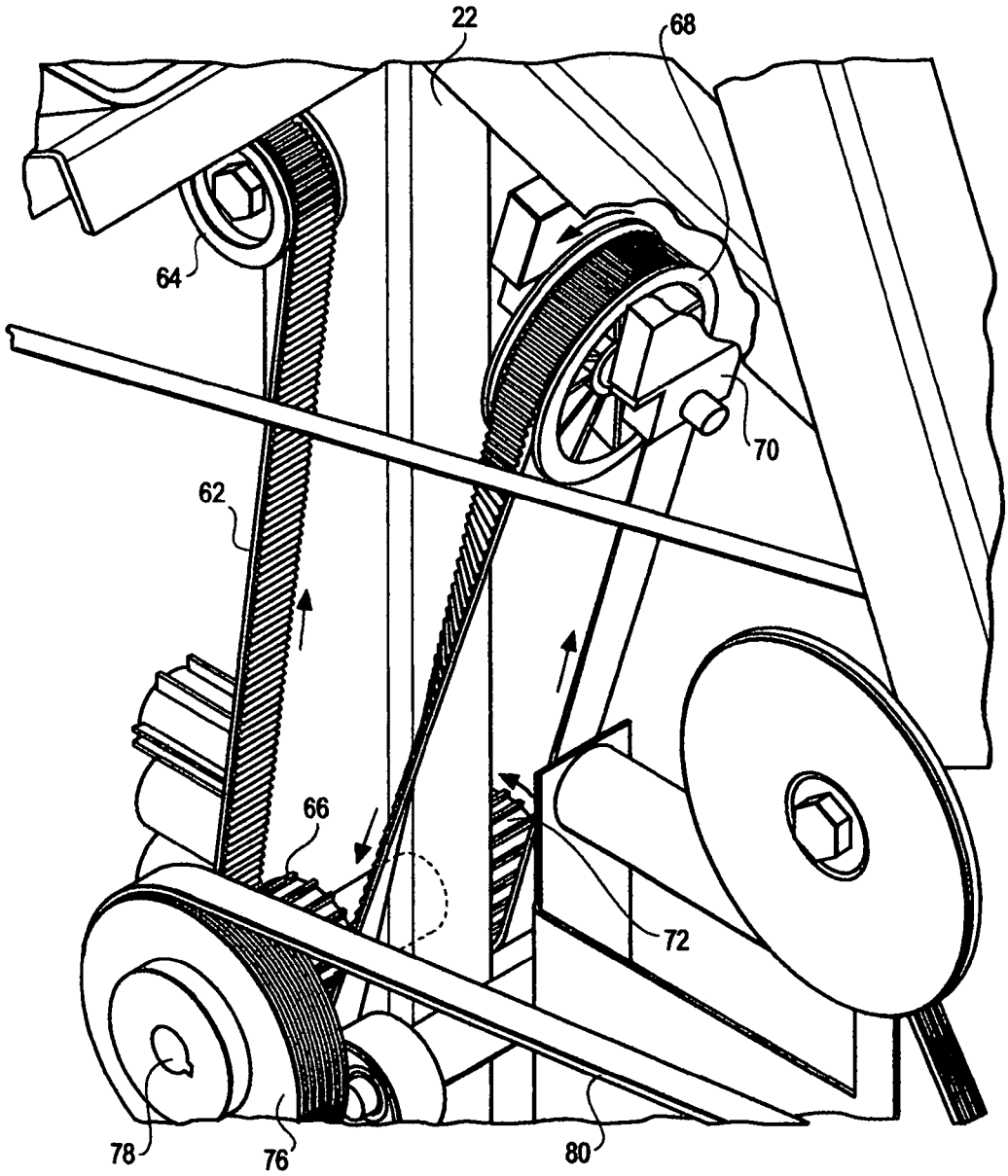
FIG. 3 is an enlarged perspective side view of a portion of the belt and pulley arrangement of the mechanism of FIG. 2B.

FIGS. 2A, 2B and 3 illustrate one type of mechanism that can be used for providing a load or resistance to movement of the pedals 42 and 44 in a downward direction. Included in the resistance mechanism, indicated generally at 74, is a drive pulley 76 secured to a shaft 78. The shaft 78 is mounted for rotation in the vertical frame member 22 and in this embodiment 10 both of the one way clutches 66 and 72 are also secured to the shaft 78 for rotation with the shaft 78. A first belt 80 is engaged with the drive pulley 76 and a first intermediate pulley 82 that is secured for rotation on a shaft 84 that in turn is mounted for rotation on the curved frame member 20. Also secured for rotation with the shaft 84 is a second intermediate pulley 86. To provide a resistance force, an alternator 88 that includes a flywheel 90 is secured to the curved frame member 20 and is connected to the second intermediate pulley 86 by a second drive belt 92 engaged with an alternator pulley 94 secured on an alternator shaft 96 as is the flywheel 90. In this embodiment of the resistance mechanism 74, the pulleys 76, 86 and 94 along with the intermediate belts 80 and 92 form a speed increasing transmission so that the alternator shaft will rotate at a significantly greater speed than the shaft 78. It will be appreciated that the transmission has been described in terms of the preferred embodiment, but there are many different arrangements that can be used for providing a resistance force to the pedals 42 and 44 including different types of transmission mechanisms such as geared arrangements and hydraulic mechanisms along with different sources of a resistance force including eddy current brakes and friction mechanisms.

Figure 4:
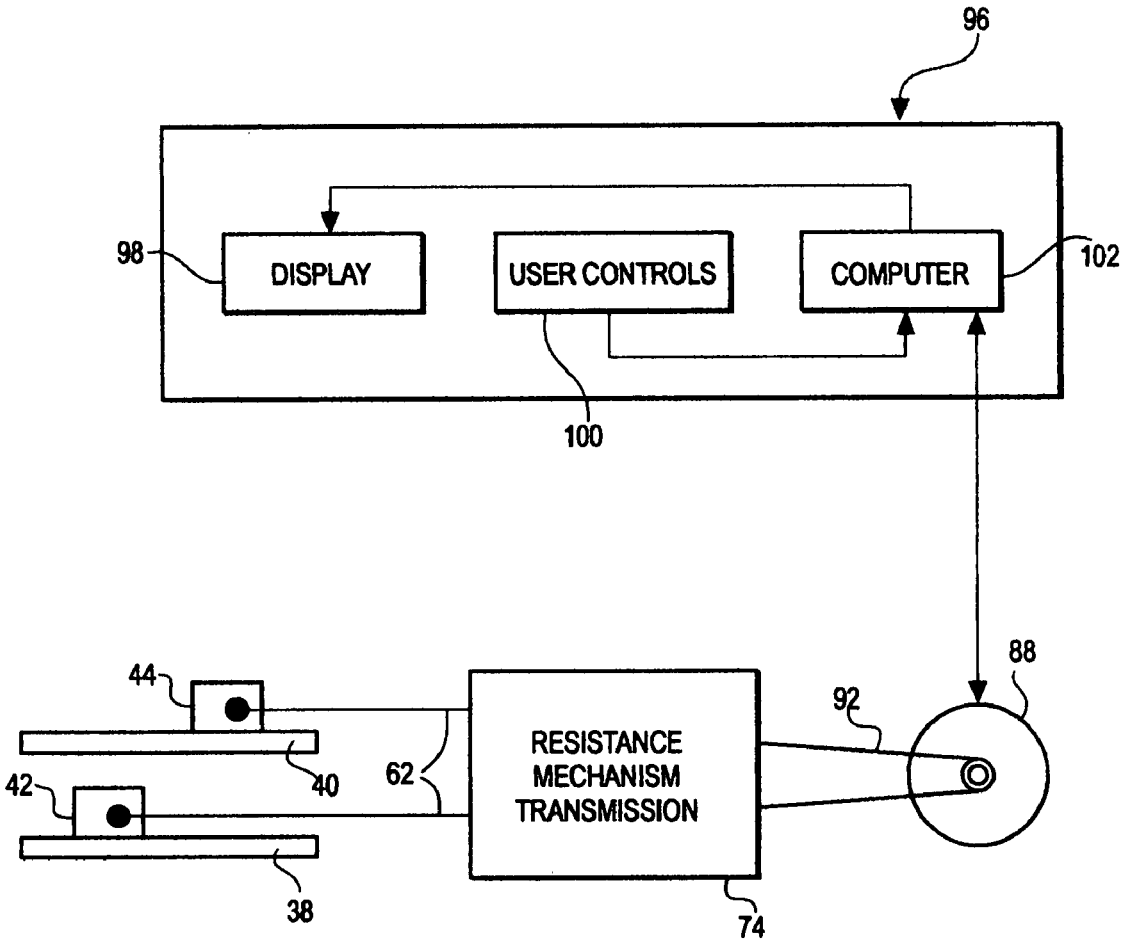
FIG. 4 is a schematic and block diagram of a control system for the mechanism of FIGS. 1 and 5.

As illustrated in FIG. 4, this embodiment 10 of the climber mechanism, also has, as is conventional in exercise equipment of this type, a control panel 96 that includes an information display 98 and a set of user controls 100. In this embodiment 10, the control panel 96 is secured to the vertical support member 24 and includes a microprocessor 102 for controlling the climbing mechanism 10. It should be noted that the microprocessor 102 or a similar control circuitry can be located elsewhere on the climber mechanism 10. One of the advantages of the type of apparatus described herein, especially the use of linear tracks 38 and 40 for the foot pedals 42 and 44 where the pedals 42 and 44 are connected for dependent operation, as for example by the single belt 62, is that it is possible for the apparatus 10 to maintain a constant torque on the one way clutches 66 and 72. This characteristic facilitates the implementation of exercise programs where either the pedals 42 and 44 are maintained at a constant speed by varying the resistance generated by the alternator 88 or the alternator 88 can be programmed to provide a constant resistance where the pedals 42 and 44 vary in speed.

The climber mechanism 10 as described above can be modified to also provide a total body exercise program. As shown in FIGS. 1-3, this embodiment of the upper body mechanism can include a pair of moveable arm handles 104 and 106. Here, the moveable arm handles 104 and 106 are pivotally attached to the vertical frame member 24 along with a pair of corresponding arm extensions or rocker members 108 and 110. The arm rockers 108 and 110 are in turn connected to the pedal support mechanisms 46 and 48 by a pair of links 112 and 114 that can be comprised of rods or metal tubes for example. It should be noted that the links 112 and 114 are preferably composed of a rigid material but, under certain circumstances, a flexible material such as a wire cable could be used where, for example, some independence between the movement of the pedals 42 and 44 and the arm handles 104 and 106 is desired. As a result of the arm handle assemblies that include the rockers 108 and 110 along with the links 112 and 114, the moveable arm handles 104 and 106 will move in synchronism with the corresponding foot pedals 42 and 44 thereby providing the user with exercise that involves his arms and upper body as well as his legs and lower body. As noted above, other arrangements can be used to connect the arm handles 106 and 108 to the pedals 44. For example, flexible members such as cables can be used instead of the rods 112 and 114 especially in the type of apparatus where the belt 52 is used to connect the pedal support mechanisms 46 and 48.

FIGS. 5-13 depict various aspects of a second and preferred embodiment 200 of a climber mechanism. As with the embodiment 10 shown in FIGS. 1-3, the climber 200 includes a control panel 96 having a display 98 and user controls 100. In general, the climber 200 can operate in the same manner as the embodiment 10 described above.

Figure 5:
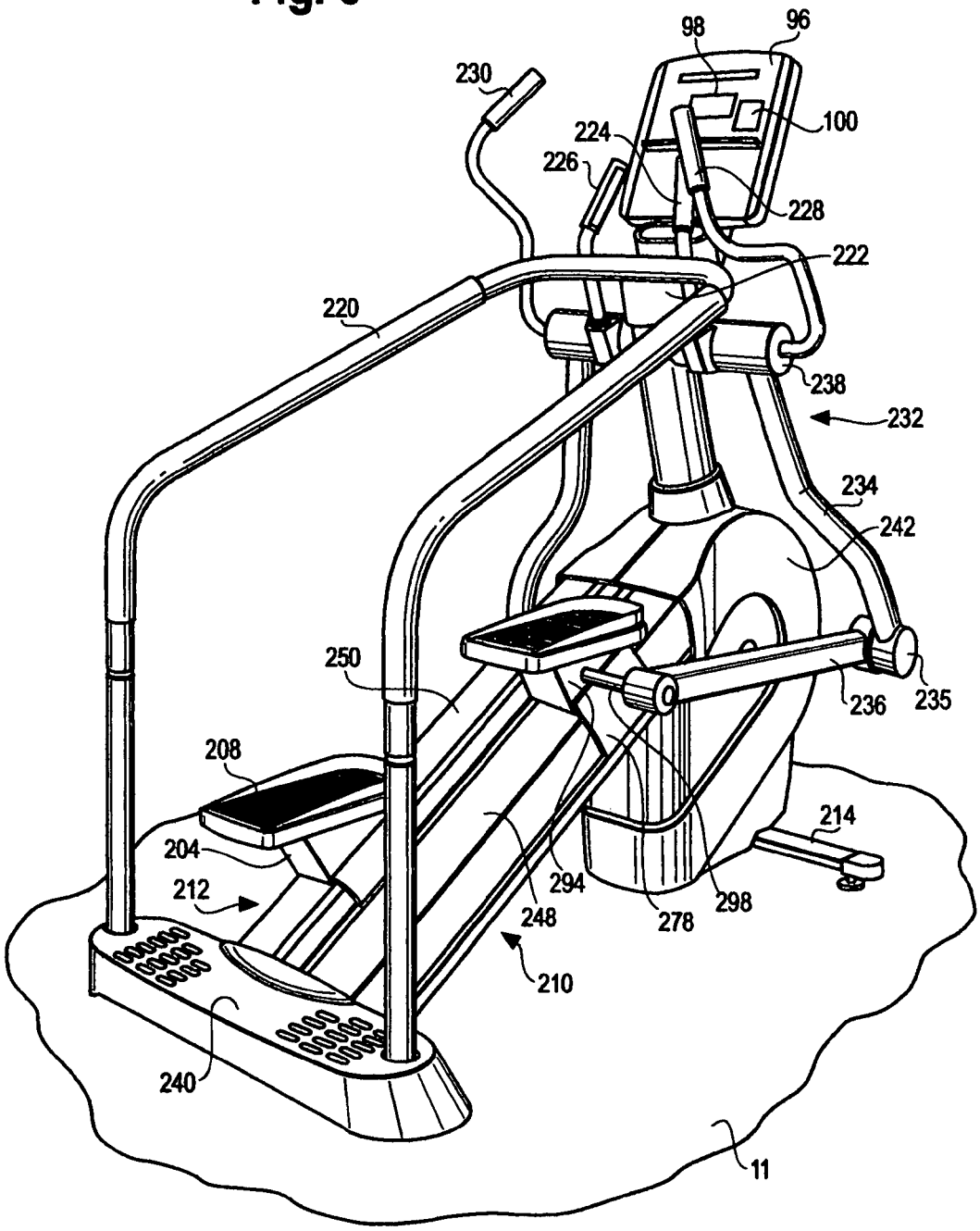
FIG. 5 is a right perspective side view illustrating certain aspects of a second embodiment of a climber mechanism.

FIGS. 5 and 6 provide perspective external views of the climber 200 that includes a pair of foot pedal assemblies indicated at 202 and 204, each having a foot pedal 206 and 208. To provide a climbing motion, the foot pedal assemblies 202 and 204 move or reciprocate along a pair of track assemblies 210 and 212 that a shown in detail in FIG. 7. Various frame elements such as a front forward floor support 214 and a vertical frame member 216 provide support for the climber 200 on the horizontal surface 11. In the preferred embodiment, the vertical support 216 is a monocolumn formed out of a generally cylindrical metal tube. A pair of side handrails 218 formed out of a cylindrical and 220 can be added to the climber 200. In the preferred embodiment, the handrails 218 and 220 are formed out of a single tubular material and are secured to the vertical member 216 by a bracket 222 or other suitable connection means. In addition to providing support for a user on the climber 200 the handrails 218 and 220, although not necessary to the operation an apparatus of the type 200, can provide additional structural support or act as part of the frame structure for the climber 200. In addition to the handrails 218 and 220, the preferred embodiment of the climber 200 includes a pair of fixed arm handles 224 and 226 that are secured to the frame and in this case the vertical frame member 216.

In the preferred embodiment, the climber 200 also provides a total body exercise capability by, in this embodiment, including a pair of movable arm handles 228 and 230 that are connected to the foot pedal assemblies 202 and 204 for movement in unison therewith. In this case, the moveable arm handles 228 and 230 are included in a pair of an arm handle assemblies where the right arm handle assembly is indicated generally by 232. Although various arrangements of levers, gears, cables, hydraulics and the like can be used, the preferred embodiment of the arm handle assembly 232 includes a rocker member 234 pivotally connected at a point 235 to a link member 236. Here, the rocker 234 is secured to a hub member 238 that in turn is free to rotate about a shaft (not shown) which can be secured to the monocolumn 216 or other parts of the frame. Also, attached to the hub 238 is the arm handle 228. As a result, the arm handle assembly 232 is effective to connect the arm handle 202 to the foot pedal assembly 202 such that the arm handle 202 will rotate back and forth as the foot pedal 206 moves up and down along the track assembly 212. The left arm handle assembly including the arm handle 230 operates in the same manner.

Another aspect of the climber 200 is the addition of a step 240 secured over the ends of the handrails 218 and 220. The step 240 makes it easier for a user mount the climber 200 by shortening the distance the user needs to reach or step on to the pedals 206 and 208. The climber 200 additionally includes a housing 242 as a protective element.

FIG. 6 illustrates another feature which is a three point support arrangement for the climber 200 where the climber 200 is essentially supported on the floor 11 by the monocolumn 216 and the handrails 218 and 220. The track assemblies 210 and 212 can also be used to provide this support. This arrangement makes it possible to do away with a longitudinal frame member such as the horizontal frame member 14 shown in FIG. 2A.

FIG. 7 is a sectioned view depicting details of the track assemblies 210 and 212 of the preferred embodiment of the climber 200. Each of the track assemblies 210 and 212 includes a track, represented by the right track 244, that are secured at their forward end to the monocolumn 216 and their reward end to a horizontal rear floor support member 246. Covering the tracks including the track 244 are a pair of track covers 248 and 250. The track cover 248 is shown in FIG. 7 in broken away form and slid upwardly and in a forward direction as indicated by an arrow 251. This arrangement allows ready access the tracks, including track 244, for assembly and maintenance purposes. Also, the preferred structure of the climber 200 includes a central structural member 252 that is directly connected between the monocolumn 216 and the rear support member 246. In this particular implementation of the track assemblies 210 and 212, a bracket arrangement 254 is used to connect the tracks, including track 244, to the central structural member 252 and hence to the monocolumn 216 and a second bracket or clamping arrangement indicated at 256 can be used to connect the tracks including track 244 to the rear support member 246 and the central structural member 252. In this embodiment, a central cover 258, shown in exploded form in FIG. 7, is used to cover the central structural member 252. Also, a pair of lower track housings, represented at 260, can be used to further enclose the track assemblies 210 and 212. The step 240, as shown in FIGS. 5 and 6, also serves to enclose the rear floor support member 246 as well as the bracket arrangement 256. It should be appreciated that by using housings and covers of the type 248, 250, 256, 258 and 260, not only can user safety be enhanced but maintenance activities can be reduced since elements of the pedal assemblies 202 and 204 as well as the track assemblies can be substantially enclosed and largely protected from sweat and other user generated debris.

Figure 8:
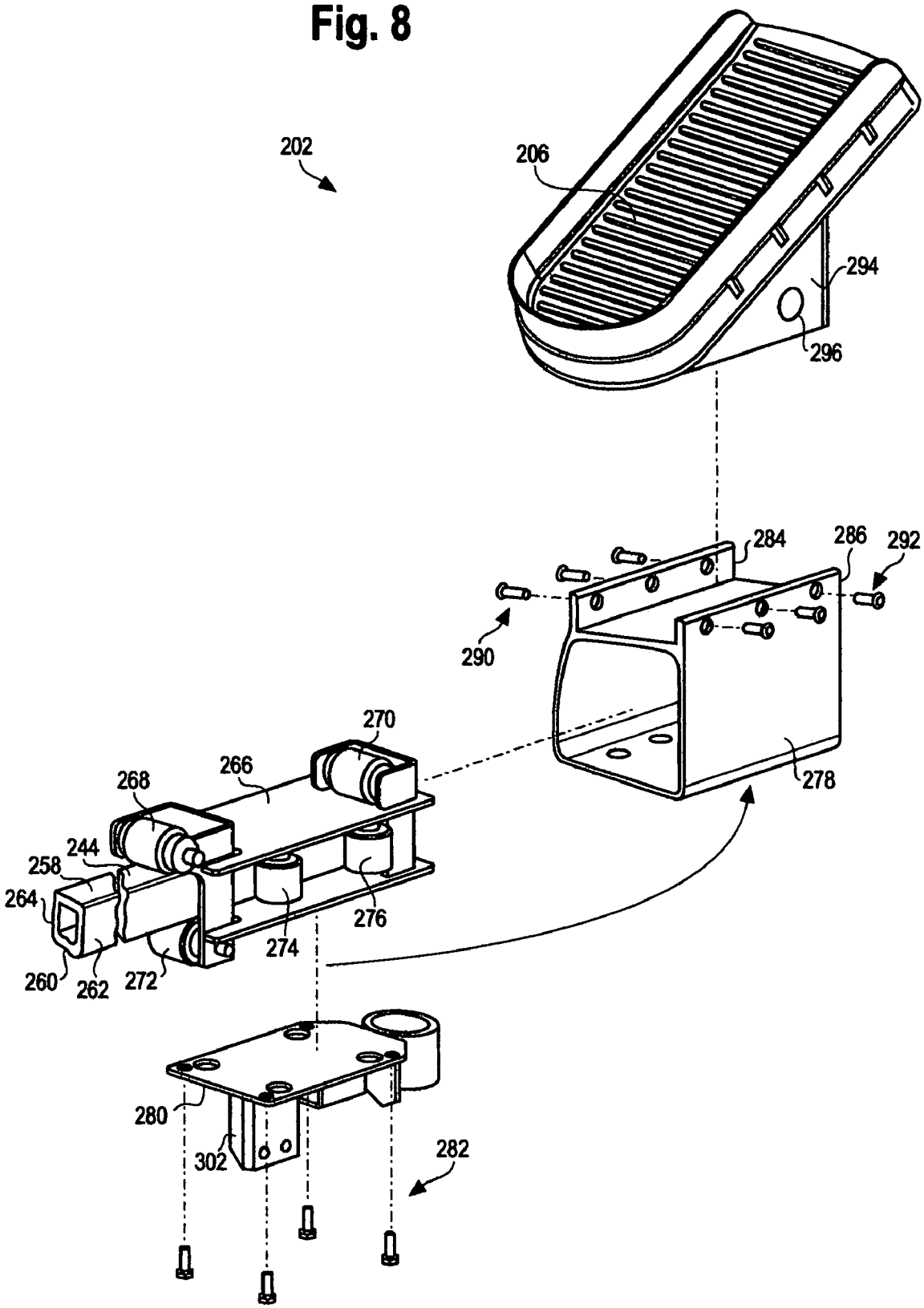
FIG. 8 is an exploded view of the pedal assembly of FIG. 8.

FIG. 8 illustrates in exploded form the preferred embodiment of the pedal assembly 204 which is configured to operate on the track 244 that has a rectangular cross-section having an upper 258 and a lower 260 planar surfaces along with a pair of planar side surfaces 262 and 264. A roller carriage 266 having a front top roller 268 and a rear top roller 270 along with a bottom roller 272 is engaged with the track 244. Additionally, the carriage 266 can also include one or more side rollers such as a set of rollers 272 and 274 that abut the lateral surface 262 of the track 244 along with one or more side rollers that abut the other lateral side surface 264 of the track 244 in order to aid in aligning the carriage 266 on the track 244. It will be appreciated, that although a number of roller arrangements can be used with a track of the type 244 such as the configuration shown in U.S. Pat. No. 6,905,441, the arrangement shown in FIG. 8 is preferred since the two top rollers 268 and 270 in combination with a single bottom roller 272 located beneath provides sufficient support for the pedal 206 on the track 244 for a climber type apparatus of the type 200, especially when the tracks are orientated at about a thirty degree angle with the floor 11.

The carriage 266 in the preferred embodiment of the pedal assembly 202 is then secured within a pedal bracket 278 with a lower attachment plate 280 with a set of fasteners indicated at 282. The pedal 206 is attached to a pair of flanges 284 and 286 configured on the upper portion of the pedal bracket 278 by a set of fasteners indicated at 290 and 292 that are secured through a pair of mounting members such as 294 configured in the pedal 206. As shown in FIGS. 5 and 6, the pedal bracket 278 also encompasses the track cover 248 permitting the carriage 266 and hence the pedal 206 to move along the track 264. In this embodiment, the mounting member 294 also includes an aperture 296 for receiving a shaft 298 that is used to pivotally connect the link 236 to the pedal assembly 202 as shown in FIG. 5.

Figure 9:
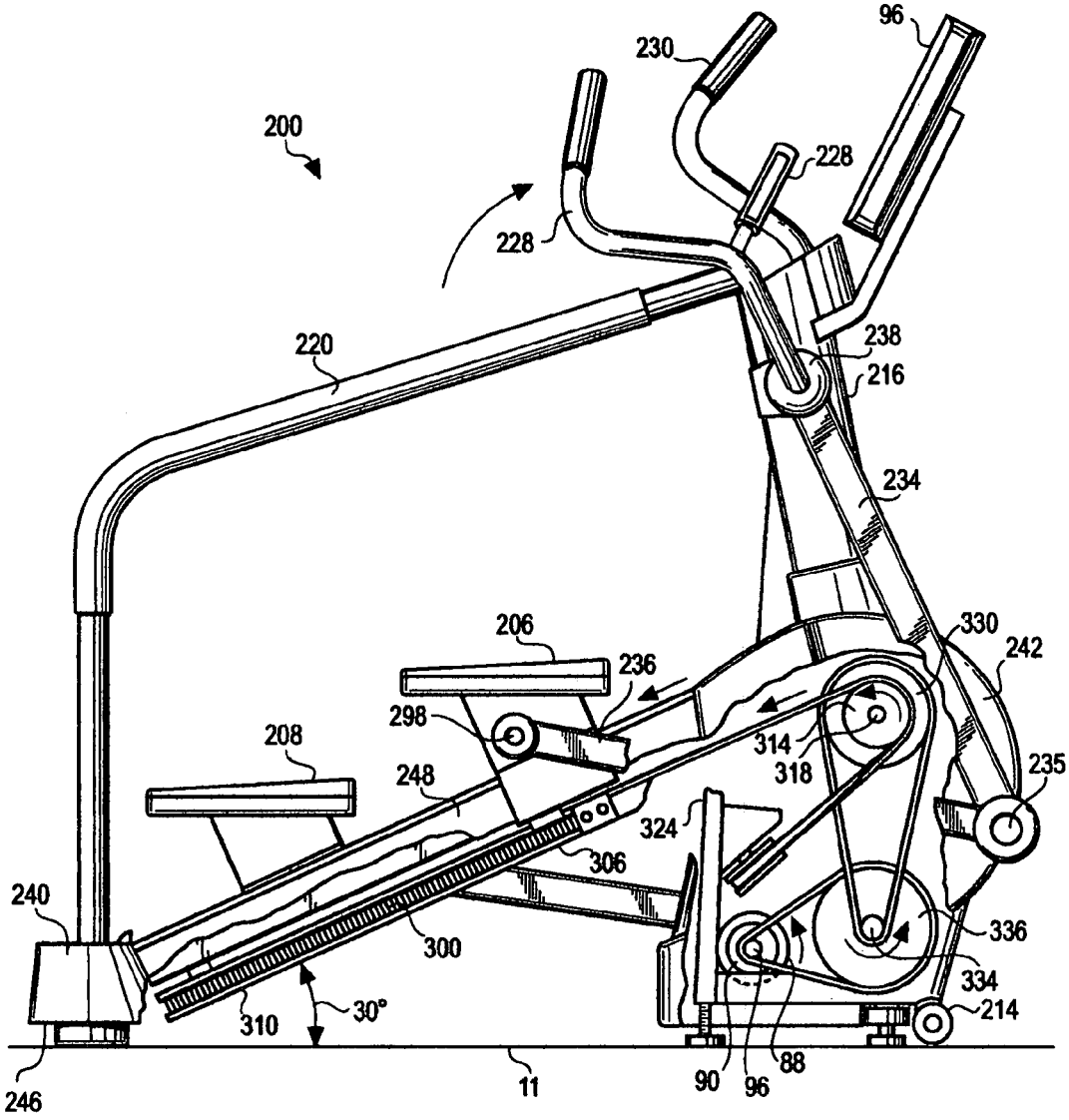
FIG. 9 is a right sectioned view of the climber of FIG. 5 illustrating a load and pedal connection assembly that can be used with the climber of FIG. 5.

FIGS. 9, 10 and 11 depict the preferred arrangement, which can be used in the climber 200 to control the operation of the pedals 206 and 208 including providing a load or resistance to the downward movement of the pedals 206 and 208. In this particular implementation of the climber 200, a belt 300 is attached to a bracket 302 and 304 that extends from the lower portion of the pedal assemblies 202 and 204 respectively. The belt 300 is attached to the brackets 302 and 304 by a pair of clamping assemblies 306 and 308 and lead around a pulley 310 that in turn is rotatably attached to the central structural member 252. Also attached by the clamping assembly 306 of the right pedal assembly 202 and to the clamping assembly 306 of the left pedal assembly 308 is a drive belt 312. As with the belt 62, the belt 312 is preferably a ribbed rubber belt but other flexible members can be used such a linked chain. In the embodiment of the climber mechanism 200 the drive belt 312 extends from the first pedal assembly 202 to a grooved pulley 314 secured for rotation with a first one-way clutch 316 that in turn is mounted for rotation on shaft 318 secured to a frame member indicated at 320. The drive belt 312 is twisted 90 degrees and extends down and under an idler pulley 322 that is mounted for rotation on a frame member 324. Twisted back 90 degrees, the drive belt 312 is engaged with a second grooved pulley 326 which is secured to a second one-way clutch 328 that is mounted for rotation on the shaft 318. The drive belt 312 then extends to the attachment point 308 on the pedal assembly 204.

As represented in FIGS. 9 and 10 in essentially schematic form, resistance is preferably provided by a mechanism that includes a drive pulley 330 secured for rotation with the shaft 318. A first belt 332 is engaged with a shaft 334 or small pulley mounted for rotation on the frame. An intermediate pulley 336 is secured for rotation on the shaft 334. To provide the resistance force, the alternator 88 that includes the flywheel 90 is mounted to the frame 20 and is connected to the intermediate pulley 336 by a second belt 338 engaged with an alternator pulley (not shown) secured on the alternator shaft 96 as is the flywheel 90. In this embodiment, the pulleys 330 and 336 along with the belts 332 and 338 form a speed increasing transmission so that the alternator shaft 96 will rotate at a significantly greater speed than the shaft 318. As with the transmission 74 described above in connection with the embodiment of FIGS. 1-3 it will be appreciated that the transmission has been described in terms of the preferred embodiment, but there are many different arrangements that can be used for providing a resistance force to the pedals 206 and 208 including different types of transmission mechanisms such as geared arrangements and hydraulic mechanisms along with different sources of a resistance force including eddy current brakes and friction mechanisms.

Figure 12A:
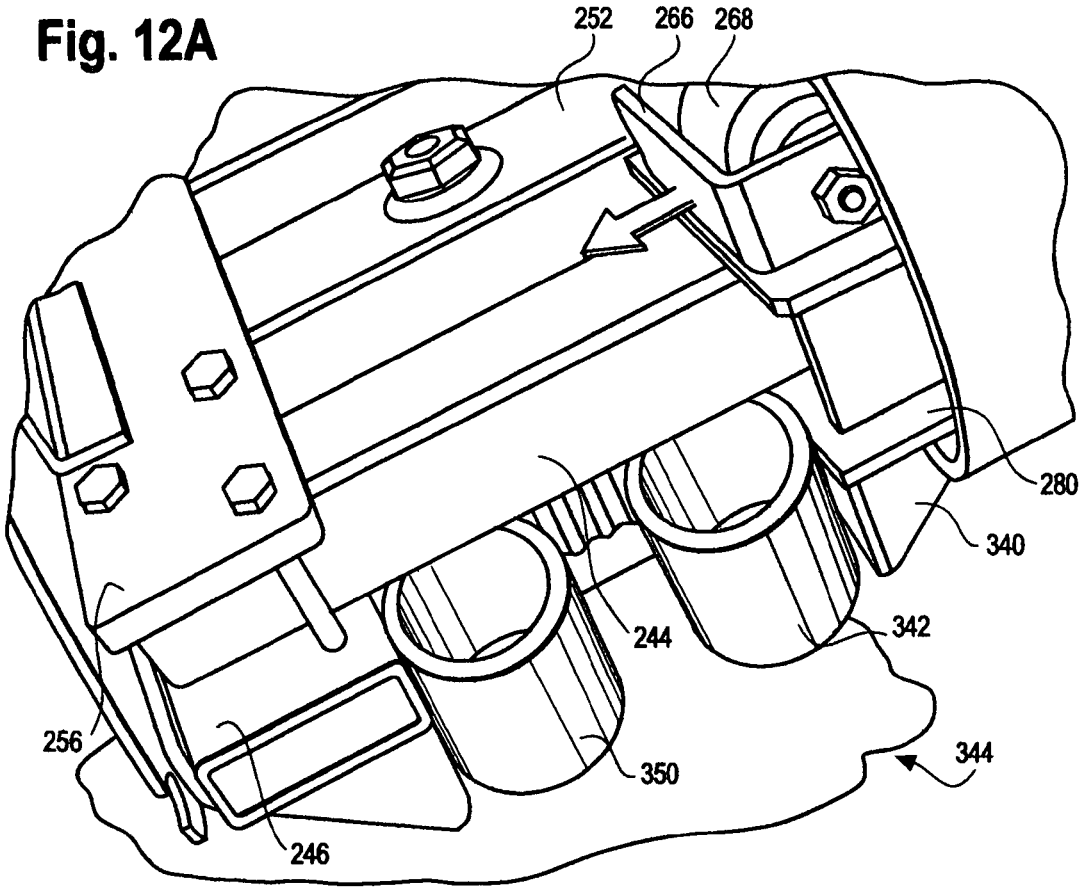
FIG. 12 A and FIG. 12B provide enlarged side perspective views of the pedal connection assembly of FIG. 11 in a first and in a second position respectively.
Figure 12B:
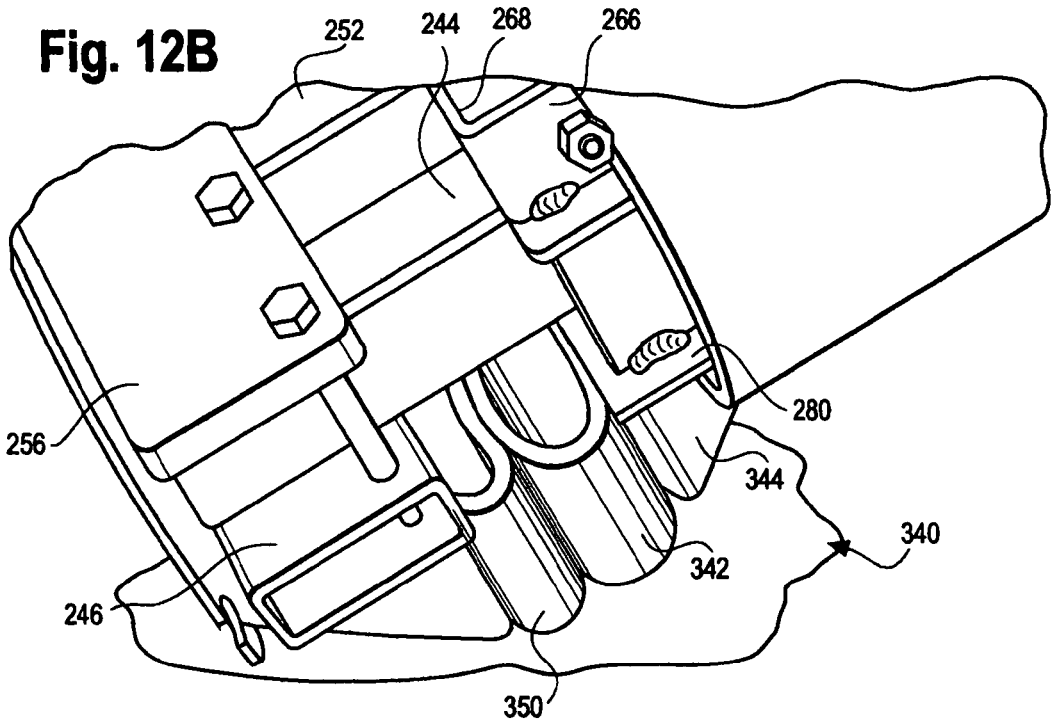

FIGS. 11, 12A and 12B illustrate the preferred embodiment of an impact absorption assembly 340 that can be used with an exercise apparatus such as the climber 200. One of the objects of the impact absorption assembly 340 is to reduce impact forces on the user's feet as the pedals 206 and 208 reach or hit the bottom of the apparatus 200. In this particular embodiment, a resilient member 342 is secured to a support flange 344 extending downwardly from the plate 280 on the pedal assembly 202 and a corresponding resilient member 346 is secured to a support flange 348 on the other pedal assembly 204. In addition to or alternatively a second set of resilient members 350 and 352 can be attached to the lower end of the climber 200 such as the member 246 and aligned with the resilient members 342 and 346 respectively so that the members 342, 346, 350 and 352 will compress when the downward motion of each of the pedals 206 and 208 terminates at the bottom of the apparatus 200 as depicted in FIGS. 12A and 12B. Although a variety of materials and configurations can be used as resilient members including metal springs, the preferred construction is an elliptically shaped member composed of an elastomeric material. One advantage of an elliptical configuration is that it provides a variable deflection rate which tends to further reduce impact stresses on the user's feet and legs. Also, as shown in FIG. 12B, one of the resilient members, here 350, has a greater deflection rate than the other resilient member 342 which can further reduce impact stresses. TECSPAK® elastomeric bumpers provide a suitable configuration and material for the resilient members 342, 346, 350 and 352.

Figure 13:
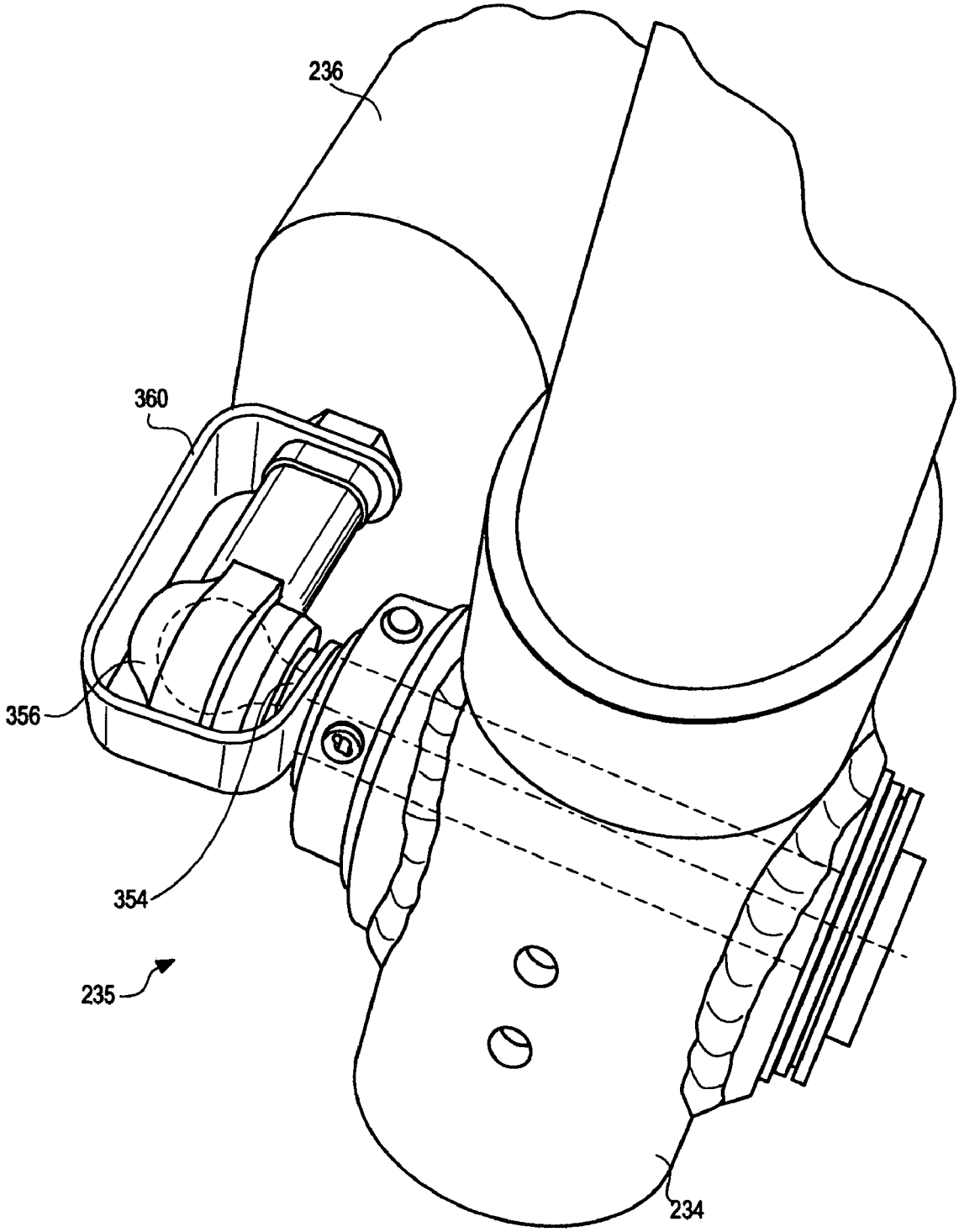
FIG. 13 is a sectioned enlarged top perspective view of a pedal link to rocker connection assembly that can be used with the climber of FIG. 5.

FIG. 13 shows a preferred method for pivotally attaching the rocker 234 to the link 236 at point 235. As depicted in the sectioned away view of FIG. 13, a shaft 354 is inserted through the rocker 234 with a ball and socket assembly 356 attaching an end 358 of the link member 236 to the shaft 354. To prevent rotation of the link 236 about its axis, a spring clip 360 is secured at a first end between the rocker 234 and the ball joint 356 on the shaft 354 and at its other end to the end 358 of the link member.

The above descriptions represent preferred embodiments of a climber mechanism intended for heavy duty health club type usage along with the preferred embodiments of various features and arrangements that can be used in this type exercise machines or related machines such as stairclimbers. The inclusion and implementation of various features such as moving arm handles, pedal mechanisms, resistive load mechanisms and shock absorption arrangements will depend on a number of factors including the purpose and cost of the apparatus. For example, for machines that are intended for health club usage a sophisticated control system is made possible by the use of an alternator whereas in a low cost home machine, a simple friction device might suffice and an impact absorption mechanism might not be considered necessary.

We claim:

1. An exercise apparatus comprising: a frame adapted for placement on a horizontal surface; a first substantially linear track secured to said frame; a second substantially linear track secured to said frame in parallel with said first track wherein said first and second tracks are secured to said frame at an incline from said horizontal surface; a first and a second foot pedal assembly, each including a foot pedal, wherein said foot pedal assemblies are engaged with said first and second tracks respectively for movement along said tracks such that said foot pedals move substantially linearly along and in parallel with said tracks; and a load mechanism, operatively connected to said first pedal assembly and said second pedal assembly, including a transmission operatively connected with said first and second foot pedal assemblies and a resistance device operatively connected to said transmission effective to provide a constant resistance to the downward movement of said first and second pedals independent of the speed of said pedal assemblies; wherein a connection mechanism connects said first pedal assembly to said second pedal assembly and to said transmission; wherein said connection mechanism includes a first flexible member attached to said first and said second pedal assemblies and to said transmission; and wherein said connection mechanism includes a second flexible member connecting said first pedal assembly to said second pedal assembly with said second flexible member engaged with said frame effective to cause said first pedal assembly to move downwardly along said first track when said second pedal assembly is moved upwardly along said second track.

2. The apparatus of claim 1 wherein said transmission includes a first and a second oneway clutch each rotatably secured to said frame and engaged with said first flexible member.

3. The apparatus of claim 2 wherein said first connection mechanism includes an idler pulley secured for rotation on said frame and said first flexible member is engaged with said idler pulley intermediate its engagement with said first oneway clutch and said second oneway clutch.

4. The apparatus of claim 1 wherein said second flexible member is engaged with an idler pulley secured for rotation on said frame.

5. The apparatus of claim 1 including a control mechanism operatively connected to said resistance device effective to vary said resistance to the downward movement of said first and second pedals in order to maintain a constant speed of said movement of said pedals.

6. The apparatus of claim 5 wherein said resistance device is an alternator and said control mechanism provides a load signal to said alternator effective to vary the output of said alternator to maintain a constant pedal speed.

7. The apparatus of claim 1 wherein said incline is approximately 30 degrees.

* * * * *